US006662610B1

(12) United States Patent
Sekita et al.

(10) Patent No.: US 6,662,610 B1
(45) Date of Patent: Dec. 16, 2003

(54) METHOD AND SYSTEM FOR BENDING

(75) Inventors: Katsuji Sekita, Kanagawa (JP); Tadahiko Nagasawa, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 0 days.

(21) Appl. No.: 09/581,174

(22) PCT Filed: Dec. 18, 1998

(86) PCT No.: PCT/JP98/05745

§ 371 (c)(1),
(2), (4) Date: Sep. 5, 2000

(87) PCT Pub. No.: WO99/32241

PCT Pub. Date: Jul. 1, 1999

(30) Foreign Application Priority Data

Dec. 19, 1997 (JP) ..... 9-351638

(51) Int. Cl.[7] ..... B21D 5/02; G06F 19/00; G06F 3/00

(52) U.S. Cl. ..... 72/31.1; 72/31.11; 72/389.3; 72/389.6; 72/702; 700/97; 700/165

(58) Field of Search ..... 700/182, 165, 700/145, 97; 395/420, 660; 72/31.1, 31.01, 31.11, 702, 389.3, 389.6

(56) References Cited

U.S. PATENT DOCUMENTS

| | | | | |
|---|---|---|---|---|
| 4,819,467 A | * | 4/1989 | Graf et al. | 72/702 |
| 5,099,666 A | | 3/1992 | Sartorio et al. | |
| 5,148,693 A | | 9/1992 | Sartorio et al. | |
| 5,497,647 A | * | 3/1996 | Nagakura | 72/389.3 |
| 5,839,310 A | * | 11/1998 | Tokai et al. | 72/31.1 |
| 5,842,366 A | * | 12/1998 | Klingel et al. | 72/31.1 |
| 5,857,366 A | | 1/1999 | Koyama | |
| 5,980,085 A | | 11/1999 | Uemura et al. | |
| 6,003,353 A | * | 12/1999 | Ootani et al. | 72/31.1 |
| 6,035,242 A | * | 3/2000 | Uemura et al. | 700/165 |
| 6,161,408 A | * | 12/2000 | Ooenoki et al. | 72/31.01 |
| 6,256,547 B1 | * | 7/2001 | Tognon | 700/165 |

FOREIGN PATENT DOCUMENTS

| | | |
|---|---|---|
| JP | 6-285548 | 10/1994 |
| JP | 8-257641 | 10/1996 |

OTHER PUBLICATIONS

English Language Abstract of JP 8–257641.
English Language Abstract of JP 6–285548.

* cited by examiner

*Primary Examiner*—David B. Jones
(74) *Attorney, Agent, or Firm*—Greenblum & Bernstein, P.L.C.

(57) ABSTRACT

A three-dimensional stereoscopic diagram creator creates a three-dimensional stereoscopic diagram including a desired bending angle based on graphic information of a product. A major dimension displayer displays a major dimension, tolerance and the like with respect to the three-dimensional stereoscopic diagram. On the other hand, a test piece displayer displays a test piece of the same material proposed for use as the material used for producing the product. The test piece displayer carries out trial bending on the test piece. A bending angle after a bending load is removed is measured by a bending angle measuring device. A spring back amount setter calculates a spring back amount from a difference in bending angle between before and after the load is removed. A stroke calculator calculates a stroke value relative to the desired bending angle considering the obtained spring back amount. Actual bending is performed on a product piece using the calculated stroke value.

12 Claims, 9 Drawing Sheets

METHOD AND SYSTEM FOR BENDING

TECHNICAL FIELD

The present invention relates generally to bending method and bending system and more particularly to bending method and bending system achieved by taking into account a spring back and elongation which accompany bending.

BACKGROUND ART

Conventionally, when a sheet material is bent, generally, a bending angle of the sheet material W is measured to confirm a processing accuracy. That is, if a bending load is removed from the sheet material w being bent, the sheet material W is returned to its original shape due to a spring back as shown in FIG. 1. Thus, if the bending angle does not reach its object angle, corrective bending is further carried out so as to carry out correction. The spring back amount can be obtained from a difference in the angle of the workpiece W between before and after the load is removed.

As for measurement of the bending angle, according to a non-contact type measurement method shown in FIG. 2, light L is projected to the sheet material W bent by cooperation of a punch P and die D and then its reflected light is received to measure a bending angle. Alternatively, according to another method, as shown in FIG. 3, an indicator 101 is brought into contact with the bent flange of the sheet material W and the bending angle is measured based on a moving amount of the indicator 101.

However, according to these conventional technologies, upon actual bending operation, a corrective bending must be carried out with measurement of the bending angle and to achieve an accurate bending, the corrective bending must be executed repeatedly, thereby necessitating much time and labor.

Further, sometimes, when the sheet material is bent, an elongation may occur, so that the bending cannot be carried out with accurate dimension.

The present invention has been achieved in views of the above described conventional technologies, and an object of the invention is to provide a bending method and bending system capable of carrying out bending with a highly accurate bending angle and dimension without executing the corrective bending repeatedly.

DISCLOSURE OF INVENTION

According to an aspect of the present invention, there is provided a bending method that includes the following steps (1) to (10):

(1) step of creating a three-dimensional stereoscopic diagram through an expansion plan based on graphic information of a product;

(2) step of displaying a major dimension and a tolerance in the three-dimensional stereoscopic diagram created in the step (1);

(3) step of displaying a test piece manufactured preliminarily of the same material as that for use in manufacturing the product;

(4) step of carrying out trial bending on the test piece displayed in the step (3) and measuring a bending angle before load removal;

(5) step of measuring a bending angle after a load is removed in the trial bending of the step (4) and measuring an elongation amount of flange width due to the bending;

(6) step of calculating a spring back amount from a bending angle before the load is removed of the step (4) and a bending angle after the load is removed of the step (5);

(7) step of obtaining an object D value from the spring back amount of the step (6) and obtaining an object L value from the elongation amount of the step (5);

(8) step of carrying out actual bending based on the object D value and the object L value;

(9) step of measuring a bending angle and a flange width after a load for the actual bending of the step (8) is removed and determining whether or not the measured angle and the measured flange width are within tolerances relative to an object angle and an object flange width; and

(10) step in which if it is determined that the measured angle and the measured flange width are within the tolerances in the step (9), the bending is terminated; and if it is determined that the measured angle and the measured flange width are not within the tolerances, a correction value D is obtained from a difference between the object bending angle and an actual bending angle; a correction L value is obtained from a difference between the object flange width and an actual bending flange width; corrective bending is carried out according to the correction D value and correction L value; the processing is returned to the step (9); and accordingly the steps (9) and (10) are repeated.

Therefore, the three-dimensional stereoscopic diagram is produced from the product graphic information and at the same time, the major dimension and the tolerance are displayed on this three-dimensional stereoscopic diagram. On the other hand, the test piece is produced preliminarily of the same material as that for use in producing a product and this test piece is displayed and bent for trail so as to obtain a spring back amount and an elongation amount of a flange dimension. Because the test piece is manufactured of the same material as the final product, the spring back amount and the elongation amount of the flange obtained from the trial bending are the same as those obtained in an actual bending on the product. Thus, an object D value for the stroke in the actual bending and an object L value for the back gauge position are set up considering the spring back amount and the elongation amount of the flange obtained as a result of the trial bending so as to carry out the actual bending. The bending angle and flange dimension in the actual bending are measured. If they are not within tolerances relative to the object bending angle and the object flange dimension, the correction D value and correction L value are calculated to carry out the corrective bending. This procedure is repeated until they fall within the tolerances.

According to another aspect of the present invention, there is provided a bending method that includes the following steps (1) to (9):

(1) step of creating a three-dimensional stereoscopic diagram through an expansion plan based on graphic information of a product;

(2) step of displaying a major dimension and a tolerance in the three-dimensional stereoscopic diagram created in the step (1);

(3) step of displaying a test piece manufactured preliminarily of the same material as that for use in manufacturing the product;

(4) step of bending the test piece displayed in the step (3) for trial based on a spring back amount and an elongation amount obtained preliminarily under various processing conditions;

(5) step of measuring a bending angle and a flange dimension of the test piece bent in the step (4) after a load is removed and then comparing the bending angle and the flange dimension with their object values;

(6) step of calculating an object D value and an object L value considering a difference between object values and measured values and various attributes; (7) step of carrying out actual bending based on the object D value and the object L value;

(8) step of measuring a bending angle and a flange width after a load for the actual bending of the step (7) is removed and determining whether or not the measured bending angle and the measured flange width are within tolerances relative to an object bending angle and an object flange; and (9) step in which if it is determined that the measured bending angle and the measured flange width are within the tolerances in the step (8), the bending is terminated; and if it is determined that the measured bending angle and the measured flange width are not within the tolerances, a correction value D is obtained from a difference between the object bending angle and an actual bending angle; a correction L value is obtained from a difference between the object flange width and an actual bending flange width so as to be stored in a data base; corrective bending is carried out according to the correction D value and the correction L value; the processing is returned to the step (9); and accordingly the steps (9) and (10) are repeated.

Therefore, the three-dimensional stereoscopic diagram is produced based on the product graphic information and at the same time, the major dimension and the tolerance are displayed in this three-dimensional stereoscopic diagram. On the other hand, a spring back amount and an elongation amount in the flange dimension are obtained preliminarily under various processing conditions for the test piece produced of the same material as that for use in producing the final product. The object D value of the stroke and the object L value of the back gauge position are set up considering these preliminarily obtained spring back amount and elongation amount in the flange dimension and then trial bending is carried out. Because the test piece is produced of the same material as the product, it is considered that the preliminarily obtained spring back amount and elongation amount in the flange are the same as those in the actual bending on the product. Therefore, the bending angle and the flange dimension in the actual bending are measured and then, the object D value and object L value are calculated considering a difference between the object bending angle and object flange dimension and various processing conditions so as to carry out the actual bending. After the actual bending, the bending angle is measured and if the measured angle is not within the tolerance, the correction D value and correction L value are calculated and the corrective bending is carried out. Then, this procedure is repeated until they fall within the aforementioned tolerances.

According to still another aspect of the present invention, there is provided a bending method for bending both sides of a major dimension portion of a workpiece to form flanges, wherein a dimension of one bent flange is measured; if the measured value is over an object value, an object L value in the other flange processing is set to be below a flange dimension by a predetermined value; if the measured value is below the object value, the object L value in the other flange processing is set to be over the flange dimension by a predetermined value; and then bending is carried out with the set object L value.

Therefore, when both sides of the major dimension portion of a workpiece are bent to form flanges, first of all, one flange is formed by bending and then its flange dimension is measured. If the measured value is over an object value, an object L value that set the other flange dimension shorter is calculated. If the measured value is below the object value, an object L value that set the other flange dimension longer is calculated and then the bending is carried out.

According to yet another aspect of the present invention, there is provided a bending method for bending both sides of a major dimension portion of a workpiece to form flanges, wherein a dimension of one bent flange is measured; and when a dimension of said major dimension portion is within a tolerance if a dimension of the other flange is the same as the dimension of said one bent flange, the workpiece is inverted and then subjected to bending with the same L value.

Thus, when both sides of the major dimension portion of the workpiece are bent to form flanges, first of all, one flange is formed by bending and its flange dimension is measured. When a dimension of said major dimension portion is within a tolerance if a dimension of the other flange is the same as the dimension of said one bent flange, the workpiece is inverted and then subjected to bending with the same L value.

According to an aspect of the present invention, there is provided a bending method for bending both sides of a major dimension portion of a workpiece to form flanges, wherein a dimension of one bent flange is measured; and if the measured value is within a tolerance, a dimension of said major dimension portion is assumed to be an object L value and said one bent flange is brought into contact with end gauges for bending.

Thus, if the dimension of one bent flange is within the tolerance, the object L value is set up with respect to the major dimension portion and then the bending is carried out.

Further, to achieve the above object, according to another aspect of the present invention, there is provided a bending system for manufacturing a product by bending a sheet material by means of a bending machine, including: three-dimensional stereoscopic diagram creating means for creating a three-dimensional stereoscopic diagram through an expansion plan based on graphic information of the product; major dimension display means for displaying a major dimension in the three-dimensional stereoscopic diagram created by the three-dimensional stereoscopic diagram creating means; test piece display means for displaying the test piece manufactured preliminarily of the same material as material for use in producing the product; a bending angle measuring device for measuring bending angles of the test piece bent by the bending machine and the product; spring back amount setting means for setting a spring back amount for the test piece; and object stroke calculating means for calculating an object D value corresponding to an object bending angle of actual bending for the product considering the spring back amount obtained by the spring back amount setting means.

Thus, the three-dimensional stereoscopic diagram creating means produces the three-dimensional stereoscopic diagram based on the product graphic information and the major dimension display means displays the major dimension, tolerance and the like in this three-dimensional stereoscopic diagram. On the other hand, the test piece display means displays the test piece manufactured preliminarily of the same material as that for use in producing the product. By bending this test piece for trial, the bending angle measuring device measures the bending angles before and after the bending load is removed (before and after the load removal). The object stroke calculating means calculates the object D value relative to the object bending angle considering the spring back amount set by the spring back amount setting means and carries out the actual bending.

According to still another aspect of the present invention, there is provided a bending system wherein the spring back amount setting means calculates the spring back amount from a difference in bending angle between before and after a load on the test piece is removed, the bending angle being measured by the angle measuring device.

Thus, the bending angles before and after the load on the test piece for the trial bending is removed are measured and the spring back amount is calculated from the difference.

According to yet another aspect of the present invention, there is provided a bending system wherein the spring back amount setting means includes a data base for storing the spring back amounts for the test piece corresponding to various processing conditions, the spring back amounts being preliminarily obtained.

Therefore, the spring back amount for a test piece to be subjected to the trail bending is set up based on the spring back amount stored in the data base corresponding to various processing conditions.

According to an aspect of the present invention, a bending system also includes a flange dimension measuring device for measuring a flange dimension of the test piece bent for trial; and an object L value calculating means for calculating an object L value corresponding to an object flange dimension in actual bending considering an elongation of the flange measured by the flange dimension measuring device.

Therefore, the flange dimension measuring device measures the flange dimension of the test piece bent for trial to obtain the elongation amount. Considering this elongation amount, the object L value calculating means calculates the object L value with respect to the object flange dimension.

According to still another aspect of the present invention, a bending system includes correction value calculating means for setting a correction D value for corrective bending to be carried out if a bending angle after the load for actual bending is removed, measured by the bending angle measuring device is not within a tolerance relative to the object bending angle, so as to put the measured bending angle within the tolerance.

Thus, if the bending angle in the actual bending is not within the tolerance which is a permissible range relative to the object bending angle, the correction value calculating means sets up the correction D value and carries out the corrective bending.

According to still another aspect of the present invention, a bending system also includes correction value calculating means for setting a correction L value for corrective bending to be carried out if a flange dimension after the load for actual bending is removed, measured by the bending angle measuring device is not within a tolerance relative to the object flange dimension, so as to put the measured flange dimension within the tolerance.

Thus, if the flange dimension in the actual bending is not within the tolerance which is a permissible range relative to the object flange dimension, the correction value calculating means sets up the correction L value and carries out the corrective bending.

According to yet another aspect of the present invention, a bending system is provided wherein a high-level NC apparatus includes the three-dimensional stereoscopic diagram creating means and the major dimension display means and a low-level NC apparatus includes the test piece display means, the bending angle measuring device, the spring back amount setting means, the object stroke calculating means, the flange dimension measuring device and the correction vale calculating means, the low-level NC apparatus belonging to a bending machine.

Thus, the three-dimensional stereoscopic diagram creating means and major dimension display means, provided on the high-level NC apparatus, create the three-dimensional stereoscopic diagram and at the same time, displays the major dimension. On the other hand, the test piece display means, the bending angle measuring device, the spring back amount setting means, the object stroke calculating means, and the flange dimension measuring device, provided on the low-level NC apparatus, carry out the trial bending on the test piece and measure the bending angles and flange dimensions before and after the bending load is removed. Further, the spring back amount and elongation amount are calculated so as to set up the object D value and the object L value. If there is a necessity, the correction D value and the correction L value are set up so as to execute the corrective bending.

BEST MODE FOR CARRYING OUT THE INVENTION

Hereinafter, the embodiments of the present invention will be described in detail with reference to the accompanying drawings.

Figure 1:
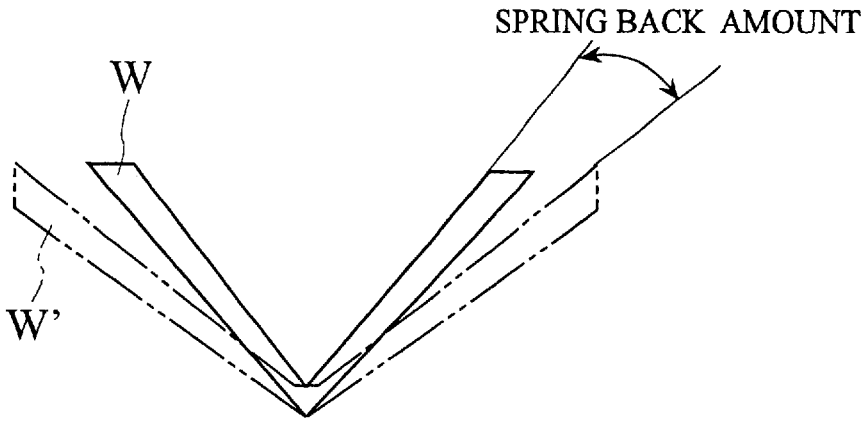
FIG. 1 is an explanatory diagram of a spring back.
Figure 2:
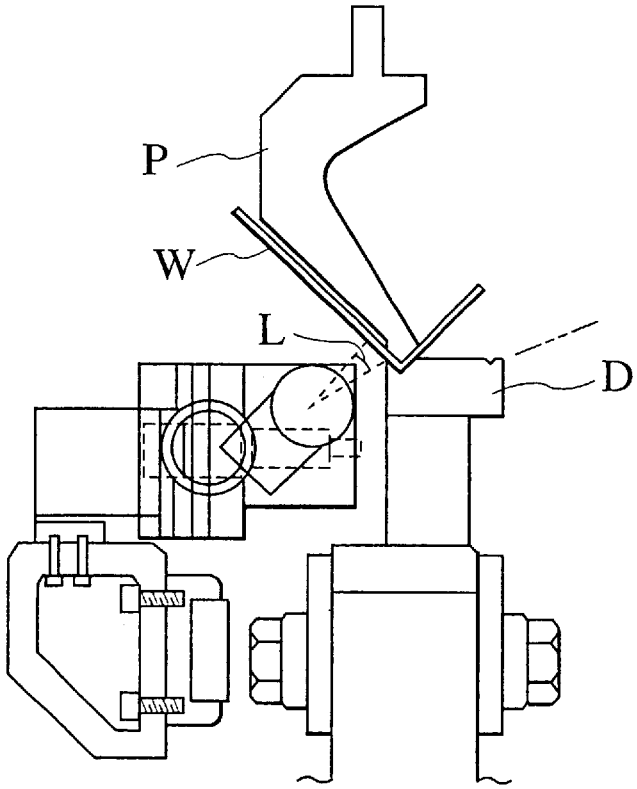
FIG.2 PRIOR ART
FIG. 2 is a side view showing a non-contact type bending angle measuring apparatus using light.
Figure 3:
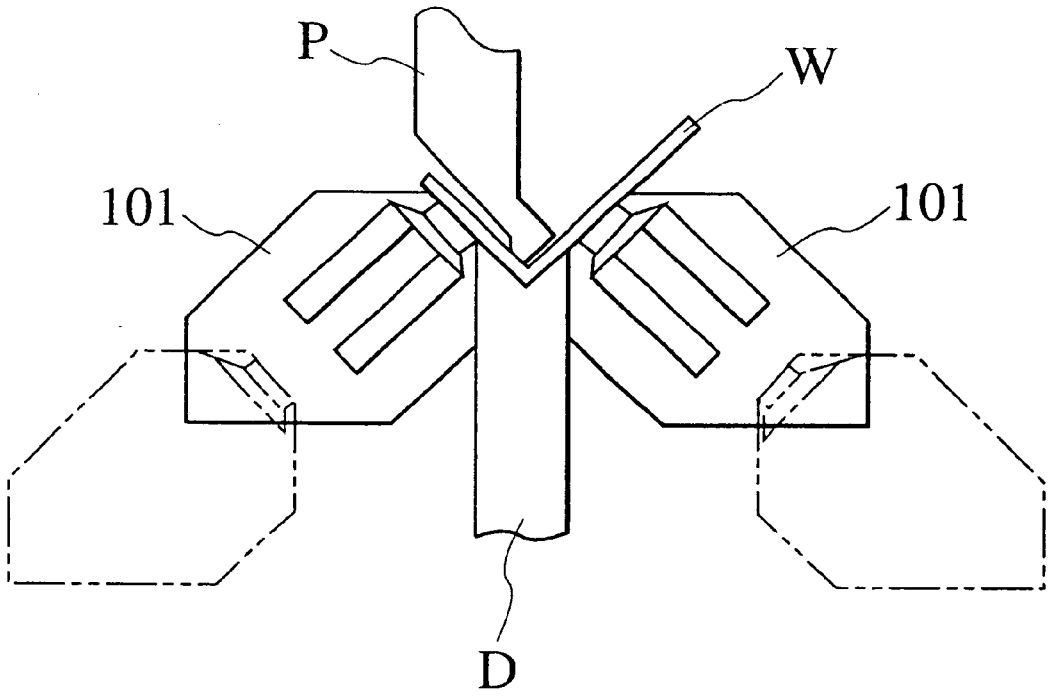
FIG.3 PRIOR ART
FIG. 3 is a sectional view showing an example of the non-contact type bending angle measuring apparatus.
Figure 4:
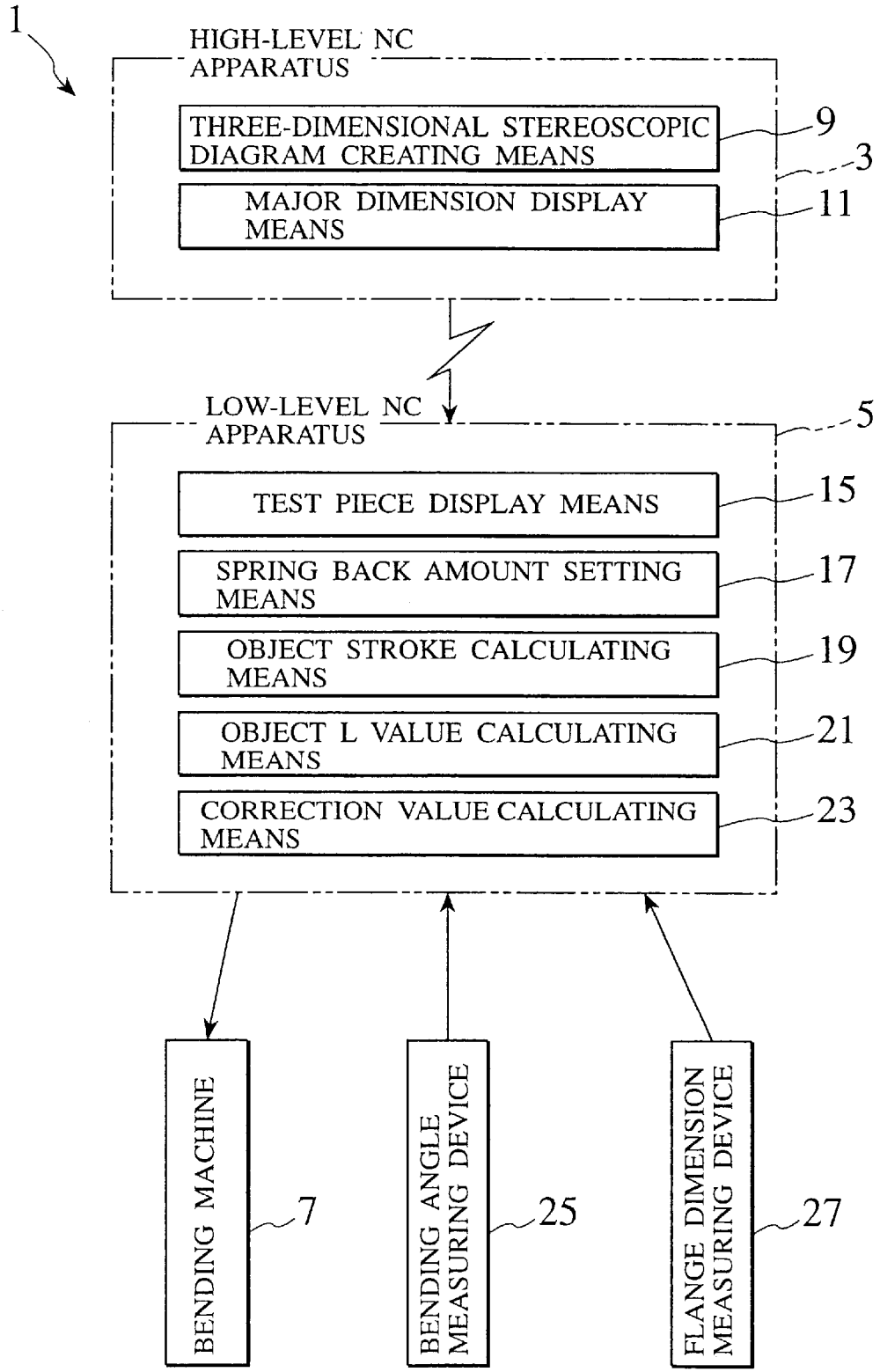
FIG. 4 is a block diagram showing a structure of a bending system according to the present invention.

FIG. 4 shows a bending system 1 according to the present invention. This bending system 1 includ a high-level NC apparatus 3 and a low-level NC apparatus 5 belonging to a bending machine 7 for bending a sheet material W.

The high-level NC apparatus 3 has three-dimensional stereoscopic diagram creating means 9, major dimension display means 11 and the like. Diagrams which will be described below are displayed on a display screen 13 (see FIG.5).

Figure 5:
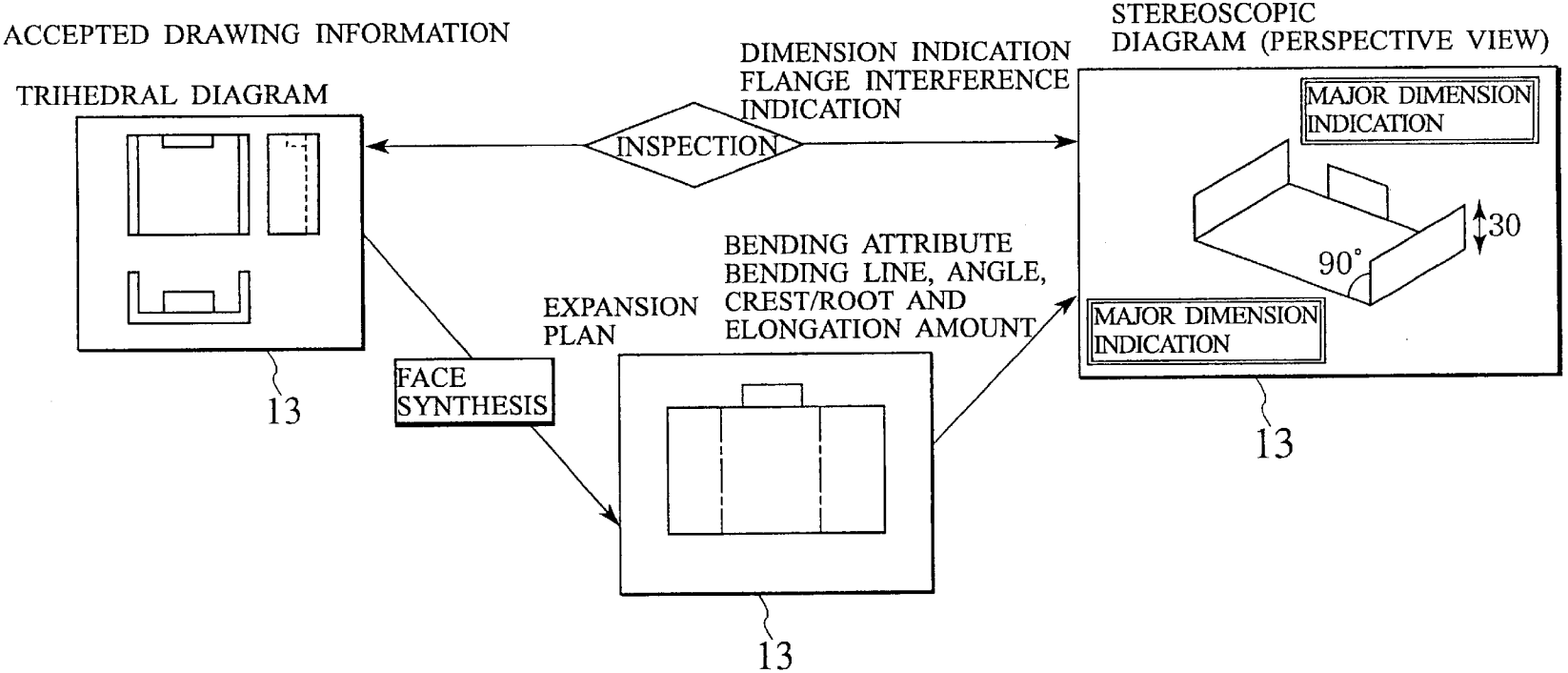
FIG. 5 is a block diagram showing processing carried out by a high-level NC apparatus.

Referring to FIG. 5, the three-dimensional stereoscopic diagram creating means 9 creates an expansion plan by face synthesis and face pick-up by means of an automatic program (CAD) based on inputted product graphic data (for example, trihedral diagram). At this time, when respective faces of the trihedral diagram are separated and corresponding faces are combined with each other successively, sheet material inner radius, die V width, bending angle, elongation, whether normal bending or inverse bending and the like are inputted as bending attribute so as to create the expansion plan. The CAD automatically creates the three-dimensional stereoscopic diagram for an actual product from the created expansion plan including those bending attributes.

Further, the following operation based on the attributes may be carried out in order to calculate more accurate dimensions of the expansion plan considering an elongation which occurs upon bending.

For example, mechanical attributes of the bending machine include deflection of upper and lower tables, deflection of a side plate, disalignment of the upper and lower tables, capacity tonnage and the like. Die attributes thereof include punch tip radius, die V width, punch bending, die pressure resistance, punch tip wear and the like. Material attributes thereof include sheet thickness, material, tensile strength, Young's modulus of elasticity and the like. Processing attributes thereof include bending order, bending speed, workpiece warpage, home position setting method and the like. Environmental attributes thereof include space, room temperature, possessed machines and the like.

The major dimension display means 11 displays major dimensions, angles, tolerances and the like which are inputted based on product graphic data corresponding to the aforementioned three-dimensional stereoscopic diagram. An operator inputs data through this major dimension display means 11.

Referring to FIG. 4 again, the low-level NC apparatus 5 connected to the high-level NC apparatus 3 includes a test piece display means 15, a spring back amount setting means 17, an object stroke calculating means 19, an object L value calculating means 21, a correction value calculating means 23 and the like. Contact type or non-contact type bending angle measuring device 25 and flange dimension measuring device 27 like calipers are connected to the low-level NC apparatus through a transmitter and a receiver which are not shown in Figures), so that measured bending angle and flange dimension are automatically transmitted to the low-level NC apparatus 5 immediately.

Figure 6:
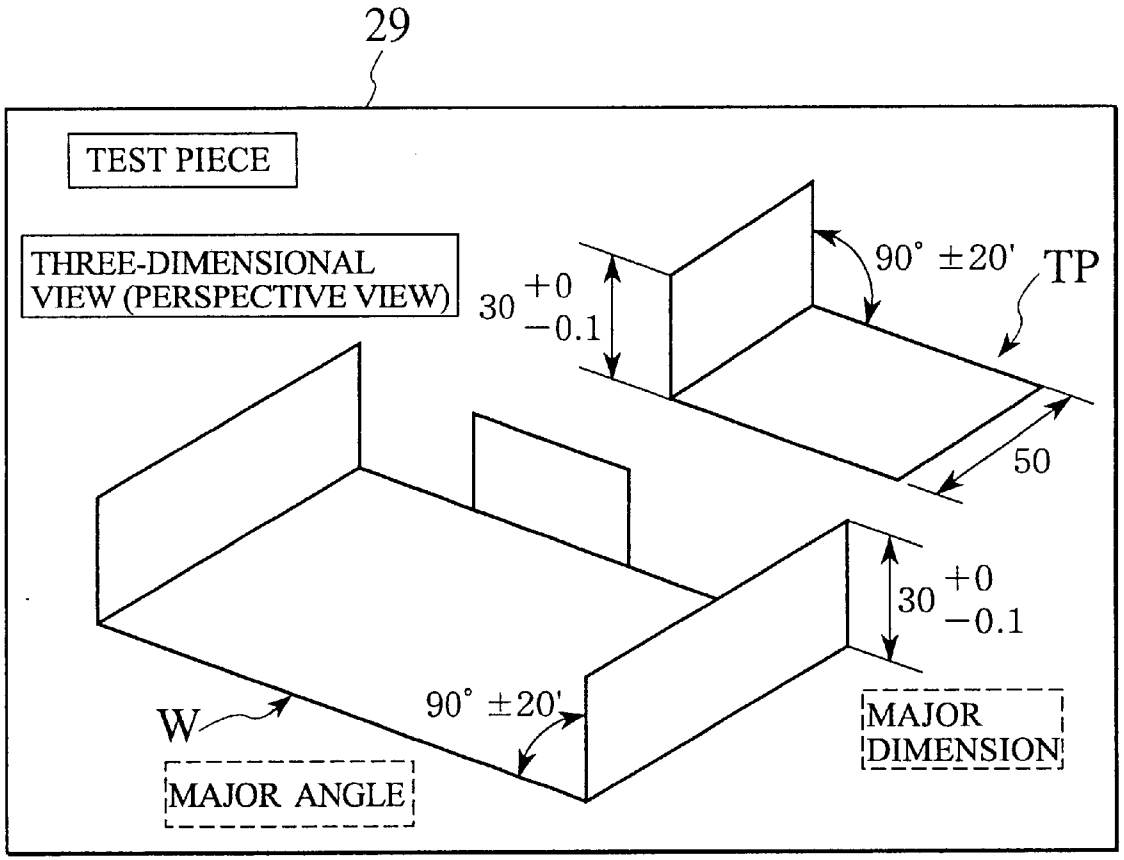
FIG. 6 is a diagram showing the content displayed on an operation panel of a low-level NC apparatus.

Referring to FIG. 6 at the same time, the test piece display means 15 displays a test piece TP. This test piece TP is produced preliminarily using a margin of a blank material for example, such that it is composed of the same material (in terms of quality and thickness) as a sheet material W for forming a product. By bending the test piece TP, it is intended to obtain a spring back amount which occurs when the sheet material w is actually bent or an elongation amount of the sheet material W accompanying the bending. In this test piece TP, the same major dimensions, angles and the like as in the aforementioned three-dimensional stereoscopic diagram are displayed. The operator exerts trial bending regarding the test piece TP displayed on the operation panel 29 of the low-level NC apparatus 5.

Referring to FIG. 4 again, the spring back amount setting means 17 carries out bending on the displayed test piece TP and measures bending angles before a load is removed (hereinafter referred to as "before load removal") and after the load is removed (hereinafter referred to as "after load removal") so as to calculate a spring back amount.

The object stroke calculating means 19 calculates an object D value for actual bending considering the spring back amount obtained by the spring back amount setting means 17. The object L value calculating means 21 calculates an object L value which determines aback gauge position considering an elongation amount obtained from a difference in the flange dimension between before and after the load removal measured by the flange dimension measuring device 27.

The correction value calculating means 23 calculates a correction D value and correction L value for corrective bending to be carried out if a bending angle measured after an actual bending does not reach the object bending angle.

The correction D value and correction L value are calculated considering the aforementioned respective attributes and consequently, data in the data base is updated thereby.

Figure 7:
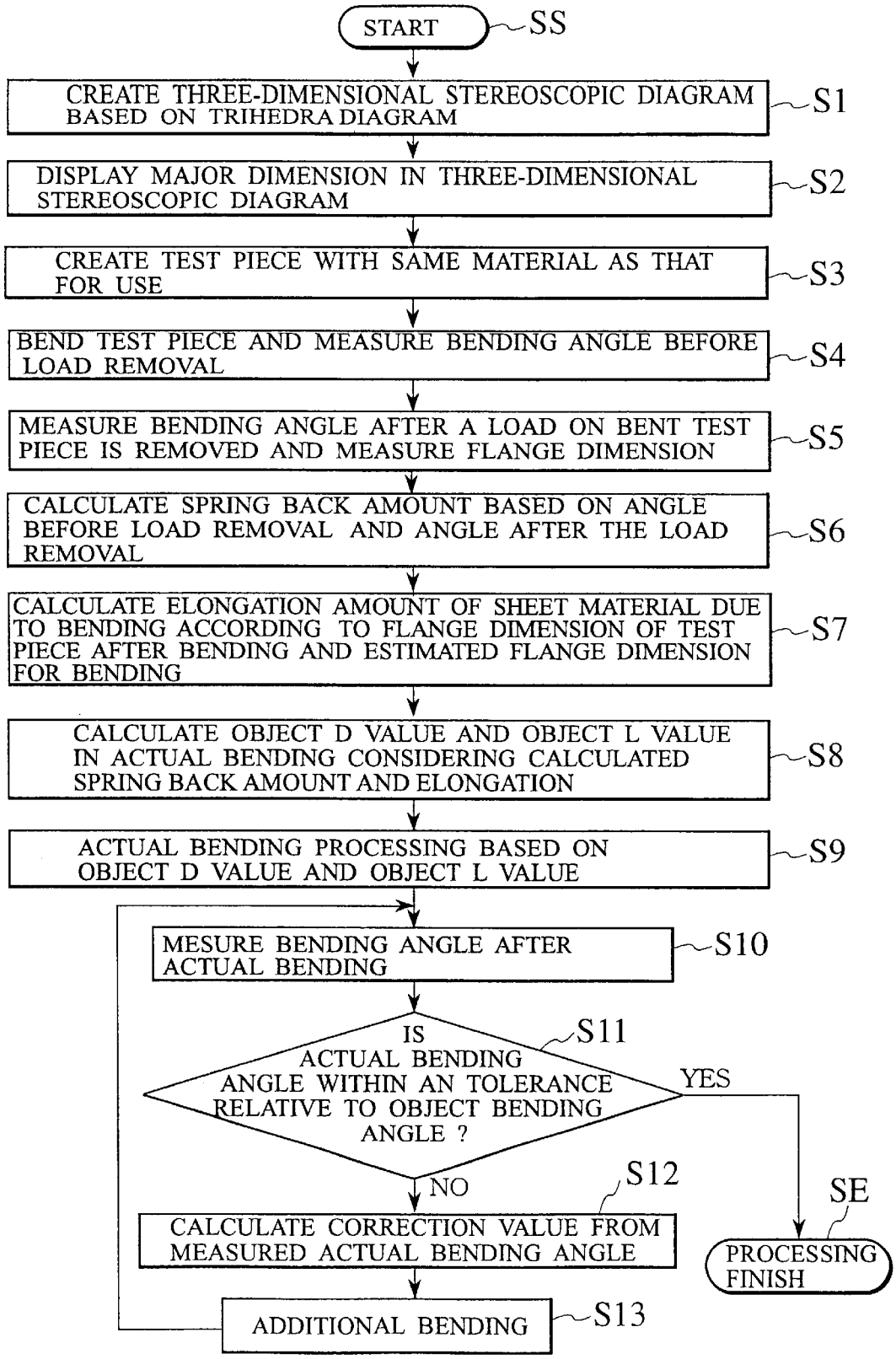
FIG. 7 is a flowchart showing respective steps of a bending method according to the present invention.

Next, bending method by the bending system 1 will be described with reference to FIG. 7.

If bending is started (step SS), the three-dimensional stereoscopic diagram creating means 9 creates a three-dimensional stereoscopic diagram (or three-dimensional perspective view) through the aforementioned expansion plan based on the trihederal diagram or the like which is graphic data of a product inputted into the high-level NC apparatus 3 (step S1). The major dimension display means 11 displays major dimensions in the three-dimensional stereoscopic diagram obtained in the previous step (step S2).

On the other hand, the test piece TP is produced using the same material as material for use in producing a product, preliminarily (step S3). Trial bending is carried out on this test piece TP so as to measure a bending angle before the load removal (step S4). At the same time, a bending angle after the load removal and the flange dimension are measured (step S5).

In this trial bending, for example, the test piece TP is bent to an object bending angle of 90° using a manual pulser and bending angles before and after the load removal are measured to obtain the spring back amount (step S6) This spring back amount can be considered to be equal to a spring back amount generated when material for use in producing a product is bent. Further, after the load removal, the flange dimension is measured and an elongation by bending is obtained (step S7). A result of measurement at this time is inputted directly into the low-level NC apparatus 5 as described above.

Thus, an object bending angle and object end gauge position are calculated considering the calculated spring back amount and elongation (step S8). For example, if the obtained spring back amount is 1° 50' and the obtained elongation is 0.3 mm, the object bending angle is 90°−1° 50'=88° 10' and the object end gauge position is −0.3 mm. Thus, an actual bending is carried out based on corresponding object D value and object L value (step S9).

A bending angle, after the load removal is carried out after the actual bending, is measured (step S10). Then, whether or not the actual bending angle is within a tolerance of the object bending angle is determined (step S11). If the actual bending angle is within the tolerance, the processing is completed (step SE). On the other hand, if the actual bending angle is not within the tolerance, a correction bending angle is obtained according to the actual bending angle and object bending angle (step S12) and then, a correction D value corresponding to this value is obtained so as to carry out corrective bending (step S13). After that, the aforementioned step S10 to step S13 are repeated until the value falls within the tolerance.

The spring back amount and elongation amount are obtained from the trial bending on the test piece TP produced with the same material as the product. Then, the object D value and object L value are setup considering this spring back amount and elongation so as to carry out the bending. Thus, an accurate bending can be carried out effectively.

Figure 8:
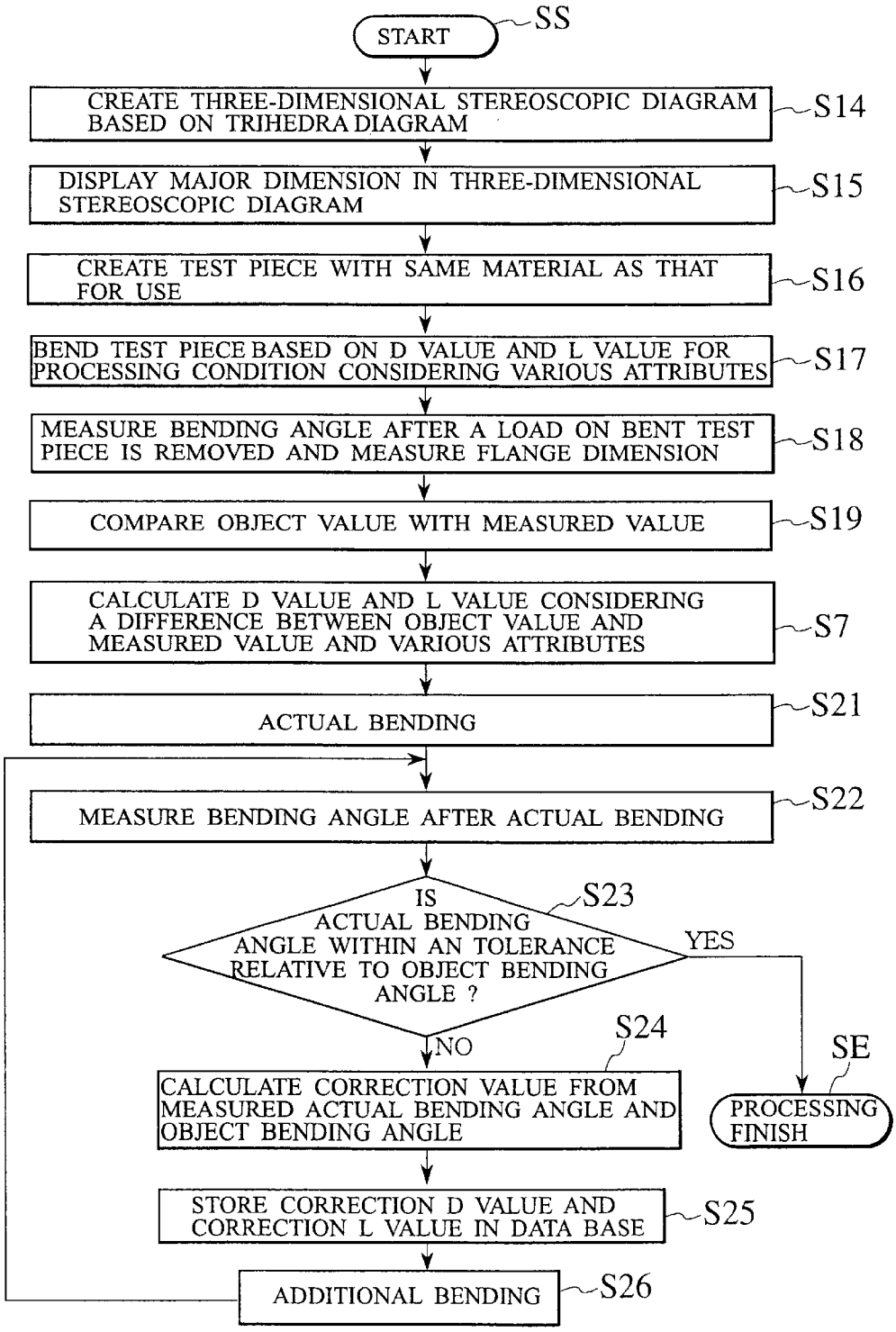
FIG. 8 is a flowchart showing respective steps of the bending method according to another embodiment of the present invention.

Next, the bending method according to another embodiment will be described with reference to FIG. 8.

The data base contains spring back amounts and elongation amounts of workpiece W under diversified processing conditions based on classified workpiece angle, sheet thickness, material, die, bending length and the like. By using these data, simple bending can be carried out without a necessity of obtaining them from the test piece TP unlike the above described embodiment.

That is, if bending is started (step SS), the three-dimensional stereoscopic diagram creating means 9 creates a three-dimensional stereoscopic diagram (or three-dimensional perspective view) through the aforementioned expansion plan based on the trihederal diagram or the like which is graphic data of a product inputted into the high-level NC apparatus 3 (step S14). The major dimension display means 11 displays major dimensions in the three-dimensional stereoscopic diagram obtained in the previous step (step S15).

On the other hand, the test piece TP is produced using the same material as material for use in producing a product, preliminarily (step S16). Then, bending is carried out on this test piece TP using the D value and L value considering the spring back amount and elongation amount corresponding to diversified processing conditions stored in the data base (step S17).

After the processing, the test piece is taken out and bending angle and flange dimension are measured (step S18). The measured angle (for example, 91°) and measured flange dimension (for example, 31 mm) are compared to each object value (step S19) and then, the correction D value and correction L value are calculated considering a difference between the measured value and object value, and respective attributes (step S20). Then, actual bending is carried out (step S21).

A bending angle and flange dimension in actual bending are measured (step S22) and whether or not they are within a tolerance relative to the object angle and dimension is determined (step S23). If they fall in the tolerance, the processing is completed (step SE). If the bending angle and flange dimension are not within the tolerances, a correction value is obtained based on a difference between the measured value and object value (step S24). The correction D value and correction L value are stored in the data base (step S25) and additional bending is carried out (step S26). Then, the aforementioned step S22 to step S26 are repeated until the measured value falls within the tolerance.

As described above, the bending is carried on the test piece considering the spring back amount and elongation amount stored in the data base. Then, the actual bending is carried out using the D value and L value set up considering this result. Thus, it is not necessary to obtain the spring back amount and elongation amount by carrying out the trial bending on the test piece TP and therefore, an accurate bending can be carried out easily.

Next, still another embodiment of the present invention will be described with reference to FIG. 9. This embodiment will be described about a case in which the flange dimension is corrected based on major dimensions.

Figure 9:
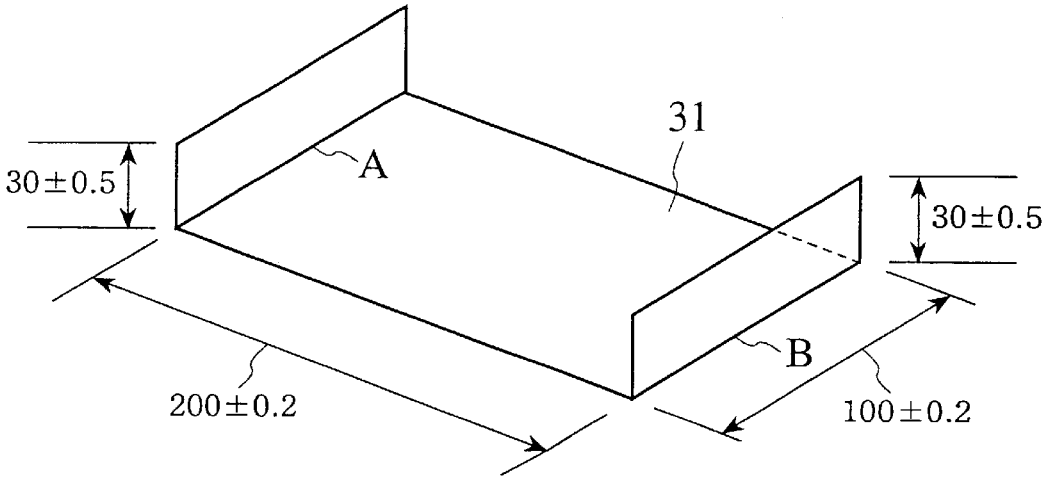
FIG. 9 is a perspective view showing major dimensions of a product.

Assuming that the major dimension of a product shown in FIG. 9 is a length (200 mm±0.2) of a bottom 31, the product and test piece are displayed on the operation panel 29. After the bending is carried out on a test piece TP of the same material and thickness as the product, the test piece TP is taken out and its flange dimension is measured. The flange dimension is 30.2 mm for example. This measured value is inputted to the NC apparatus 5 and the bottom dimension of the product which is the major dimension is estimated from the above measured value. That is, because the bending is executed under the same processing condition, 30.2 mm is estimated here.

Figure 10A:
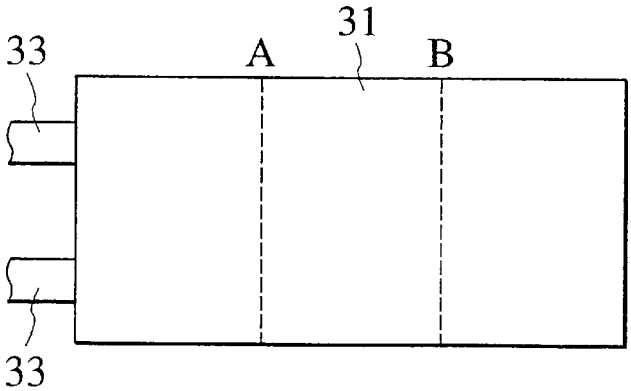
FIGS. 10A and 10B are explanatory diagrams showing an inversion condition after the above bending processing.
Figure 10B:
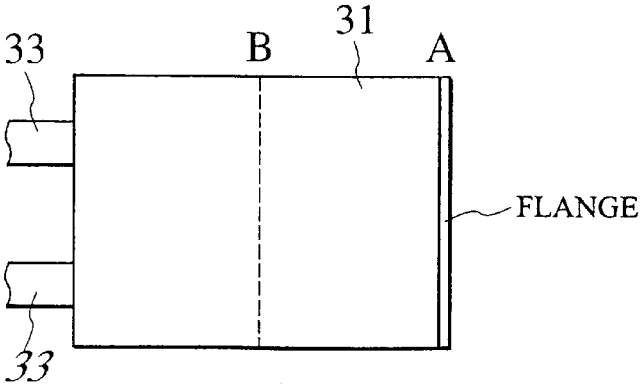

Therefore, it is estimated that the bottom dimension is 200−0.2≧=199.6 mm, however this value is out of the tolerance of the bottom dimension. Then, considering that the flange dimension of 30.2 mm of a previous bending exceeds the object value (30 mm), the bending is carried out so that the flange dimension of the other side is below the object value. That is, the test piece is inverted from a state in which the end gauges 33 make contact therewith as shown in FIG. 10A to a state shown in FIG. 10B and at the same time, by setting the flange dimension to 29.8 mm, the flange on an opposite side is bent. Because the tolerance for the flange dimension is large, the flange dimension can be adjusted sufficiently.

As a result, it is estimated that the dimension of the bottom 31 which is the major dimension is 200 mm and there fore, the major dimension can be included with in the tolerance.

Alternatively, because as a result of the bending on the test piece, the flange dimension is 30.2 mm and then, the bottom dimension which is the major dimension is 199.6 mm, which can not be included with in the tolerance, it is permissible to calculate the L value so that both the flange dimensions are 30.1 mm and carry out the actual bending on this condition.

Figure 11A:
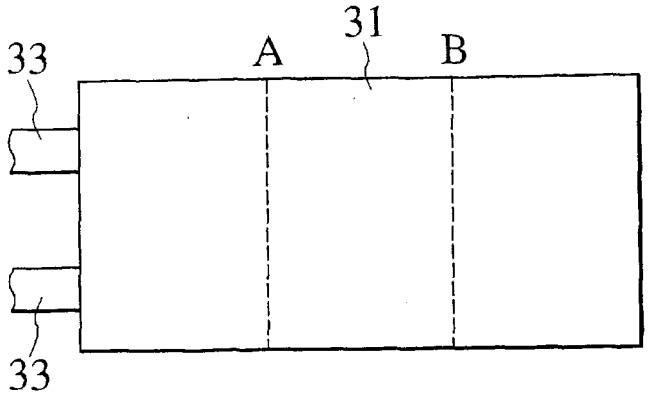
FIGS. 11A, 11B and 11C are explanatory diagrams showing a relation between end gauges and a workpiece.
Figure 11B:
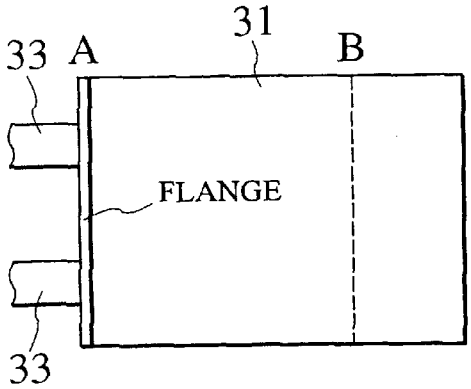
Figure 11C:
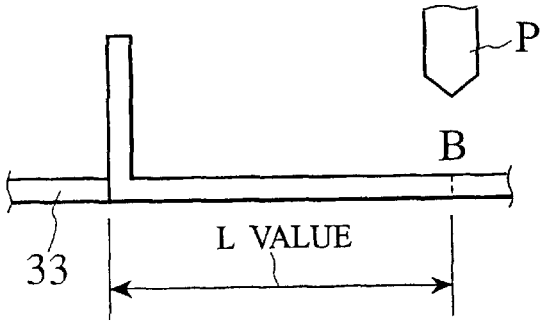

If as shown in FIGS. 11A and 11B, the flange dimension is within the tolerance as a result of measurement after one flange is bent, the bent flange is brought into contact with the end gauges. As shown in FIG. 11C, the L value is determined so that the dimension of the bottom 31 is 200 mm and then the bending is carried out.

Consequently, the bottom dimension which is the major dimension can be included within the tolerance easily. Thus, accurate bending can be carried out easily.

Meanwhile, the present invention is not restricted to the previously described embodiments, and however, can be carried out in other embodiments through appropriate modification. That is, although in the previously described embodiments, the bending system 1 includes the high-level NC apparatus 3 and the low-level NC apparatus 5, the bending system may be composed of only the low-level NC apparatus 5 attached to the bending machine and in this case also, the same operation and effect can be obtained.

Industrial Applicability

As described above, according to the bending method of the present invention, the three-dimensional stereoscopic diagram is created from product graphic information and major dimensions and tolerances are displayed in the three-dimensional stereo scopic diagram. Therefore, processing contents can be grasped easily and accurately. On the other hand, a test piece manufactured preliminarily with the same material as a final product is represented and a spring back amount and an elongation amount of the flange dimension are obtained by trial bending. Considering the spring back amount and elongation amount of the flange obtained by the trial bending, an object D value for a stroke in actual bending and object L value for back gauge position are set up so as to carry out the actual bending. Thus, an accurate bending can be achieved effectively. Further, if the bending angle and flange dimension in the actual bending are not within the tolerances of the object bending angle and object flange dimension, corrective bending is executed based on calculated correction D value and correction L value.

Further, according to the bending method of the present invention, the three-dimensional stereoscopic diagram is created from product graphic information and major dimensions and tolerances are displayed in the three-dimensional stereoscopic diagram. Therefore, processing contents can be grasped easily and accurately. On the other hand, a spring back amount and an elongation amount of the flange dimension under a processing condition considering various attributes for the test piece produced preliminarily of the same material as a final product are obtained beforehand and then, an object D value of the stroke and an object L value of the back gauge position are set up considering this spring back amount and elongation amount of the flange. Thus, a time and labor for calculating the spring back amount can be eliminated. Because the test piece is manufactured of the same material as the final product, the spring back amount and elongation amount of the flange are considered to be of the same values as those obtained in the actual bending for the product. Thus, if a bending angle and flange dimension in trial bending are measured and the object D value and L value are calculated considering a processing condition taking a difference between the object bending angle and object flange dimension and various attributes into account so as to carry out the actual bending, a highly accurate bending can be expected from the first. If a bending angle after the actual bending is measured and it is not within its tolerance, a correction D value and correction L value are calculated to carry out corrective bending. Then, this procedure is repeated until they fall within the tolerance. Thus, highly accurate bending can be executed rapidly and effectively.

Further, according to the bending method of the present invention, if flanges are subjected to bending on both sides of a major dimension portion of the work piece, first one flange is subjected to bending and its flange dimension is measured. If a measured value exceeds an object value, an object L value for setting the other flange dimension shorter is calculated. If the measured value is below the object value, the object L value for setting the other flange dimension longer is calculated and bending is carried out. Therefore, the major dimension portion can be included within the allowable range quickly.

Further, according to the bending method of the present invention, if flanges are subjected to bending on both sides of a major dimension portion of the work piece, first one flange is subjected to bending and its flange dimension is measured. In case where the other flange dimension is the same, if the dimensions of the aforementioned major dimension portion fall within the tolerance, the other flange on an opposite side is subjected to bending. Thus, the major dimension portion can be included within the allowable range quickly.

Further, according to the bending method of the present invention, if one flange dimension produced by bending is within the allowable range, the object L value is set by a dimension for the major dimension portion and then, bending is executed. Therefore, the bending on the major dimension portion can be carried out securely and rapidly.

Further, according to the bending system of the present invention, the three-dimensional stereoscopic diagram creating means creates a three-dimensional stereoscopic diagram based on graphic information of a product and the major dimension display means indicates the major dimensions, tolerances and the like in this three-dimensional stereoscopic diagram. Thus, the processing contents can be grasped easily and accurately. On the other hand, the test piece display means displays a test piece manufactured of the same material as the final product and carries out trial bending. Then, the spring back amount setting means obtains a spring back amount and sets up an object D value for the stroke in an actual bending considering the spring back amount obtained by the trial bending so as to carry out the actual bending. Therefore, the bending can be executed at a highly accurate bending angle effectively.

Further, according to the bending system of the present invention, bending angles before and after the load removal of a test piece subjected to the trial bending are measured and then, the spring back amount can be calculated according to a difference therebetween.

According to the bending system of the present invention, a spring back amount is set up for a test piece to be bent for trial with reference to the spring back amounts stored in the data base corresponding to various processing conditions. Thus, the spring back amount can be set up rapidly and easily.

Further, according to the bending system of the present invention, the flange dimension measuring device measures a flange dimension of a test piece bent for trial so as to obtain an elongation amount. The object L value calculating means calculates the object L value relative to the object flange dimension considering this elongation amount so as to carry out the actual bending. Thus, the bending can be executed at an accurate flange dimension.

Further, according to the bending system of the present invention, if the bending angle in the actual bending is not within the tolerance which is an allowable range relative to the object bending angle, the correction value calculating means sets up a correction D value so as to carry out corrective bending. Therefore, the bending can be execute data highly accurate bending angle.

Further, according to the bending system of the present invention, if the flange dimension in the actual bending is not within the tolerance which is an allowable range relative to the object flange dimension, the correction value calculating means sets up a correction L value so as to carry out corrective bending. Therefore, the bending can be executed with accurate flange dimensions.

Further according to the bending system of the present invention, the three-dimensional stereoscopic diagram creating means provided in the high-level NC apparatus having a large processing capacity creates a three-dimensional stereoscopic diagram and the major dimension display means displays a major dimension. Thus, a large amount operation can be carried out rapidly. Further, the test piece display means, bending angle measuring device, spring back amount setting means, object stroke calculating means and flange dimension measuring device provided on the low-level NC apparatus attached to a bending machine together carry out trial bending on the test piece and measures the bending angles before and after the load removal and flange dimensions, so as to calculate the spring back amount and elongation amount. Then, the object D value and object L value are set up and if required, the correction D value and correction L value are set up to execute corrective bending. Therefore, the structure of the low-level NC apparatus can be reduced in size.

What is claimed is:

1. A bending method, comprising:

creating a three-dimensional stereoscopic diagram including a desired bending angle based on graphic information of a product;

obtaining a test piece of a material proposed for use in the product;

bending the test piece, measuring bending angles before and after a load removal, and measuring an elongation amount of flange width due to the bending;

calculating a spring back amount of the test piece from the measured bending angles of the test piece before and after the load is removed;

obtaining an stroke value from the calculated spring back amount and obtaining a back gauge value from the measured elongation amount;

bending a product piece based on the obtained stroke value and back gauge value;

measuring a bending angle and a flange width of the product piece after a load for the bending is removed and determining whether the measured bending angle and the measured flange width of the product piece are within tolerances relative to the desired bending angle and a desired flange width; and terminating the bending when it is determined that the measured bending angle and the measured flange width of the product piece are within the tolerances; and when it is determined that the measured bending angle and the measured flange width of the product piece are not within the tolerances, obtaining a correction stroke value from a difference between the desired and measured bending angles of the product piece, obtaining a correction back gauge value from a difference between the desired flange width and the measured flange width, and performing corrective bending according to the correction values.

2. A bending method, comprising:

creating a three-dimensional stereoscopic diagram including a desired bending angle, based on graphic information of a product;

obtaining a test piece of a material proposed for use in the product;

bending the test piece based on a preliminary spring back amount and a preliminary elongation amount;

measuring a bending angle and a flange dimension of the bent test piece after a load is removed and comparing the measured bending angle and the flange dimension with the desired bending angle and a desired flange dimension;

calculating a stroke value and a back gauge value using a difference between the desired bending angle and flange dimension values and the measured bending angle and flange dimension values;

bending a product piece based on the calculated stroke value and the back gauge value;

measuring a bending angle and a flange dimension of the product piece after a load for the bending is removed and determining whether the measured bending angle and the measured flange dimension of the product piece are within tolerances relative to the desired bending angle and the desired flange dimension; and when it is determined that the measured bending angle and the measured flange dimension are within the tolerances, the bending is terminated; and when it is determined that at least one of the measured bending angle and the measured flange dimension are not within the tolerances, a correction stroke value is obtained from a difference between the desired bending angle and the measured bending angle, a correction back gauge value is obtained from a difference between the desired flange dimension and the measured flange dimension, so as to be stored in a data base, and corrective bending is carried out according to the correction stroke value and the correction back gauge value.

3. A bending system for manufacturing a product by bending a sheet material using a bending machine, comprising:

a three-dimensional stereoscopic diagram creator that creates a three-dimensional stereoscopic diagram including a desired bending angle based on graphic information of the product;

a test piece displayer that displays a test piece of a material proposed for use in the product;

a bending angle measuring device for measuring bending angles of the test piece bent by the bending machine, and for measuring angles of the product bent by the bending machine;

a spring back amount determiner that determines a spring back amount for the test piece; and a stroke calculator that calculates a stroke value corresponding to the desired bending angle for the product considering the spring back amount obtained by the spring back amount determiner.

4. A bending system according to claim 3, wherein said spring back amount determiner calculates the spring back amount from a difference in bending angles between before and after a load on the test piece is removed, the difference in bending angles being measured by said bending angle measuring device.

5. A bending system according to claim 3, wherein said spring back amount determiner includes a data base for storing the spring back amounts for the test piece corresponding to a plurality of processing conditions.

6. A bending system according to claim 3, further comprising:

a flange dimension measuring device for measuring a flange dimension of the test piece; and a back gauge value calculator that calculates a back gauge value corresponding to a desired flange dimension considering an elongation of the flange measured by the flange dimension measuring device.

7. A bending system according to claim 3, further comprising a correction value calculator that sets a correction stroke value for corrective bending to be carried out when a bending angle after the load for actual bending is removed, measured by said bending angle measuring device, is not within a tolerance relative to the desired bending angle, so as to put the measured bending angle within the tolerance.

8. A bending system according to claim 6, further comprising a correction value calculator that calculates a correction back gauge value for corrective bending to be carried out when a flange dimension after the load for actual bending is removed, measured by said flange dimension measuring device, is not within a tolerance relative to the desired flange dimension, so as to put the measured flange dimension within the tolerance.

9. A bending system according to claim 3, wherein a high-level NC apparatus comprises said three-dimensional stereoscopic diagram creator and a low-level NC apparatus comprises the test piece displayer, the bending angle measuring device, the spring back amount determiner, and the stroke calculator, said low-level NC apparatus belonging to a bending machine.

10. A bending method, comprising:

bending a test piece by applying a load, measuring bending angles before and after a load removal, and measuring an elongation amount of flange width due to the bending;

calculating a spring back amount of the test piece from the measured bending angles of the test piece before and after the load is removed, obtaining a stroke value from the calculated spring back amount of the test piece, and obtaining a back gauge value from the measured elongation amount of flange width of the test piece;

bending a product piece based on the calculated stroke value and the back gauge value, measuring a bending angle and a flange width of the product piece after a load removal, and determining whether the measured bending angle and the measured flange width of the product piece are within predetermined tolerances; and terminating the bending when the measured bending angle and the measured flange width of the product piece are within the tolerances; and when the measured bending angle and the measured flange width of the product piece are not within the tolerances, obtaining a correction stroke value and a correction back gauge value, and performing corrective bending according to the correction values.

11. A bending method, comprising:

bending a test piece based on a preliminary spring back amount and a preliminary flange elongation amount, by applying a load, and measuring a bending angle and a flange dimension of the bent test piece after the load is removed;

calculating a stroke value and a back gauge value using a difference between a desired bending angle and the measured bending angle, and a difference between a desired flange dimension and the measured flange dimension;

bending a product piece based on the calculated stroke value and the back gauge value, measuring a bending angle and a flange dimension of the bent product piece after a load is removed, determining whether the measured bending angle and the measured flange dimension are within predetermined tolerances; and terminating the bending when the measured bending angle and the measured flange dimension of the product piece are within the tolerances; and when the measured bending angle and the measured flange dimension of the produce piece are not within the tolerances, obtaining a correction stroke value and a correction back gauge value, and performing corrective bending according to the correction values.

12. A bending system for manufacturing a product by bending a sheet material using a bending machine, comprising:

a bending angle measuring device that measures bending angles of a test piece before and after the test piece is bent by the bending machine;

a spring back amount determiner that determines a spring back amount for the bent test piece; and a stroke calculator that calculates a stroke value corresponding to a desired bending angle for a product piece based on the spring back amount obtained by the spring back amount determiner for the test piece.

* * * * *